US011309099B2

(12) United States Patent
Kim et al.

(10) Patent No.: US 11,309,099 B2
(45) Date of Patent: Apr. 19, 2022

(54) DISPOSAL CONTAINER FOR HIGH-LEVEL RADIOACTIVE WASTE USING MULTIPLE BARRIERS AND BARRIER SYSTEM USING THEREOF

(71) Applicant: KOREA RADIOACTIVE WASTE AGENCY, Gyeongju-si (KR)

(72) Inventors: Seung-Hyun Kim, Sejong-si (KR); Hyung-Jin Kim, Daejeon (KR); Hyung-Ju Yun, Daejeon (KR); Chang-Min Shin, Daejeon (KR); Min-Seok Kim, Daejeon (KR); Jeong-Hwan Lee, Daejeon (KR); Sang-Hwan Lee, Daejeon (KR); Man-Ho Han, Daejeon (KR); Tae-Man Kim, Sejong-si (KR)

(73) Assignee: KOREA RADIOACTIVE WASTE AGENCY, Gyeongju-Si (KR)

( * ) Notice: Subject to any disclaimer, the term of this patent is extended or adjusted under 35 U.S.C. 154(b) by 0 days.

(21) Appl. No.: 17/290,096

(22) PCT Filed: Aug. 21, 2019

(86) PCT No.: PCT/KR2019/010617
§ 371 (c)(1),
(2) Date: Apr. 29, 2021

(87) PCT Pub. No.: WO2020/091208
PCT Pub. Date: May 7, 2020

(65) Prior Publication Data

US 2021/0398703 A1 Dec. 23, 2021

(30) Foreign Application Priority Data

Oct. 31, 2018 (KR) ..... 10-2018-0132248

(51) Int. Cl.
*G21F 9/34* (2006.01)
*G21F 1/08* (2006.01)
(Continued)

(52) U.S. Cl.
CPC ..... *G21F 9/34* (2013.01); *G21F 1/08* (2013.01); *G21F 1/12* (2013.01); *G21F 5/10* (2013.01)

(58) Field of Classification Search
CPC ..... G21F 1/08; G21F 1/12; G21F 5/10
(Continued)

(56) References Cited

U.S. PATENT DOCUMENTS 3,885,922 A * 5/1975 Thomas, Jr. ..... B23K 9/038 428/683
4,292,528 A 9/1981 Shaffer et al.
(Continued)

FOREIGN PATENT DOCUMENTS

EP 0296855 A2 12/1988
JP 03-216596 A 9/1991
(Continued)

*Primary Examiner* — Nicole M Ippolito
(74) *Attorney, Agent, or Firm* — Novick, Kim & Lee, PLLC; Jae Youn Kim

(57) ABSTRACT

The present invention relates to a disposal container and a storage system for high-level radioactive waste and, more specifically, to a disposal container for high-level radioactive waste using multiple barriers and a barrier system using thereof, the disposal container having the multiple barriers consisting of an inner wall made of carbon steel for excellent corrosion resistance and ease of manufacture, a middle wall made of Inconel, which is bonded to a lateral surface of the inner wall, and an outer wall made of copper, which is bonded to a lateral surface of the middle wall.

6 Claims, 8 Drawing Sheets

(51) Int. Cl.
*G21F 1/12* (2006.01)
*G21F 5/10* (2006.01)

(58) Field of Classification Search
USPC ..... 250/505.1, 506.1, 507.1, 515.1, 516.1, 250/517.1, 518.1, 519.1
See application file for complete search history.

(56) References Cited

U.S. PATENT DOCUMENTS

| | | | | |
|---|---|---|---|---|
| 2019/0021545 | A1* | 1/2019 | Southard | B32B 27/14 |
| 2019/0301098 | A1* | 10/2019 | Draper | D21G 3/005 |

FOREIGN PATENT DOCUMENTS

| | | | |
|---|---|---|---|
| JP | 09-068594 | A | 3/1997 |
| JP | 2008-107361 | A | 5/2008 |

* cited by examiner

DISPOSAL CONTAINER FOR HIGH-LEVEL RADIOACTIVE WASTE USING MULTIPLE BARRIERS AND BARRIER SYSTEM USING THEREOF

TECHNICAL FIELD

The present invention relates to a disposal container and a storage system for high-level radioactive waste and, more specifically, to a disposal container for high-level radioactive waste using multiple barriers and a barrier system using thereof, the disposal container having the multiple barriers consisting of an inner wall made of carbon steel for excellent corrosion resistance and ease of manufacture, a middle wall made of Inconel, which is bonded to a lateral surface of the inner wall, and an outer wall made of copper, which is bonded to a lateral surface of the middle wall.

BACKGROUND ART

High-level radioactive waste (hereinafter, "high-level waste") refers to waste which contains high levels of radioactive materials, indicating waste solution resulting from the reprocessing of Spent Nuclear Fuel (SNF), or the SNF itself.

In spite of utilization of SNF recycling technology such as pyroprocessing, etc., and management of the volume-reduced SNF in Generation-IV Reactor such as Sodium-cooled Fast Reactor, etc., the volume is small, however high-level waste is still generated. Thus, as long as human beings utilize nuclear power as an energy source, high-level waste is an inevitable consequence, and the importance of development of technology for safe disposal can not be overemphasized.

Especially, high-level waste requires extremely special management due to high amount of long-lived radioactive nuclides (I-129, Cs-134, Sr-90, Pu-238, Am-241, Cm-244, etc.) and decay heat generated from such nuclides. Not only is it difficult to perform incineration or chemical treatment towards high-level waste, but radioactive materials are generated during few million years. Thus, it is extremely dangerous to store radioactive materials near residences of people. As long as industrial society of human beings becomes more advance, production of high-level waste is inevitable. Therefore, it is highly important to develop technologies for safely treating and disposing such waste, socially, nationally, and even worldwidely. Furthermore, it is extremely significant to develop such technologies for human beings' safe future.

The only way to dispose of materials (radioactive materials, heavy metals, etc.), generated from high-level waste and dangerous to human beings, provided that there is no special disposal technology, is to dispose these materials deep beneath the surface, extremely kept away from human living environment. This is an eco-friendly way in which such materials coming from nature send back to nature, and harmful property against human beings becomes extinct automatically after a long period of time. The time period of isolating high-level waste from human environment requires tens of thousands of years, or several hundreds of thousands of years.

From earlier, in 1956, the National Academy of Science (NAS) recommended searching several rock formation including bedded salt for deep geological disposal, wherein the deep geological disposal is appropriate for high-level waste treatment. Since the 1970s, USA, France, Canada, Japan, Swiss, Belgium, Sweden, Finland, etc., have accumulated technologies concerning deep geological disposal in accordance with each country's state. Accordingly, the technology development of deep geological disposal, as an eco-friendly waste disposal technology, has been well under way already in several major countries. As a deep geological disposal, currently being developed, there is a method for burying high-level waste in repositories at a depth of 500 to 1,000 metres below the ground's surface. Actually, in Finland, the world's largest nuclear power plants are under construction in Olkiluoto Island located in the northwest of Helsinki, a capital, along with deep geological repositories of high-level waste. And, in Sweden, a place to which underground repositories are installed has been determined in June, 2009. Since 2005, in France, a mine in 490 metres in length has been dug into underground in Bure in eastern France, and underground disposal research facilities of deep geological disposal which is 5 meters in diameter and 535 metres in total length has been installed, thereby focusing on a thorough investigation for complete disposal of high-level waste.

In Korea, research on deep geological disposal technology of high-level waste, led by Korea Atomic Energy Research Institute, has been conducted since 1997. As a result, underground research tunnel (KURT) has been established in November, 2006, thereby developing a technological barrier system consisting of a disposal container, a buffer, and a back filler, preventing leakage of radioactive materials due to introduction of multiple barrier concepts, and performing a research on movement of underground water. The core technologies of such deep geological disposal of high-level waste are to develop a disposal container for sealing high-level waste, and to build deep geological repositories of the disposal container in which high-level waste is sealed and develop operations technologies. The factors affecting such technology developments are radioactive materials and decay heat generated from high-level waste, geological features of deep geological repositories of high-level waste, underground water which goes into repositories and its movement, shear deformation in supporting rock of deep geological repositories due to crustal movement like earthquake, etc.

Actually, in order to endure disposal condition for a long disposal period (approximately 10,000 to 1,000,000 years) at a depth of 500 to 1,000 metres below the ground's surface in deep geological environment, the disposal container has to be designed to have sufficiently structural strength, easy production/delivery/treatment, and light weight for minimizing differential settlement by dead load of the disposal container upon disposal.

For example, Korean Patent No. 10-1046515 discloses a module disposal container of high-level waste canister and buffer material, more particularly, the disposal container of high-level waste for storing and disposing high-level waste to deep underground rock, comprising: a canister, vacuum inside, for storing the high-level waste; a buffer material for storing the canister; and a shell, made of corrosion-resistant and high-intensity material, installed to the lateral surface of the buffer material, wherein the canister, the buffer material and the shell are integrated, and the buffer material and the shell are in polygonal-side shape; and a disposal system for storing and disposing high-level waste to the deep underground comprising: a disposal container which includes a canister for storing high-level waste, a first buffer material, in polygonal-side shape, for being integrated to the outside of the canister, and a shell, made of corrosion-resistant and high-intensity material, installed to the lateral surface of the first buffer material; a repository tunnel for being installed by digging rock formation and storing the disposal container in order to settle polygonal sides of the disposal container; a second buffer material, made of pure bentonite and installed between the disposal container and the repository tunnel; and a back filler for filling empty spaces between the second buffer material and the repository tunnel.

Further, Korean Patent Publication No. 10-2010-0057238 discloses a module system of high-level waste canister and buffer material, more particularly, a disposal system of high-level waste for storing and disposing high-level waste to deep underground rock, a canister for storing high-level waste; a disposal container for storing the canister and a mixed buffer material; a disposal repository tunnel for being formed by digging rock formation and storing the disposal container; a second buffer material, made of pure bentonite and formed between the disposal container and the disposal repository tunnel; and a back filler for filling empty spaces between the second buffer material and the repository tunnel.

However, such disposal container is mostly cylindrical and comprised of one-type metal material and the disposal container and fillers are filled inside of the titanium, square-shaped shell. Thus, the intensity of the disposal container is relatively weak.

Furthermore, as for disposal container, it is important to make sure to maintain integrity no matter what kind of loads are applying in underground environment. The magnificent perspectives on selecting material of the disposal container are physicochemical factors, manufacturing convenience, and economical efficiency. The physicochemical factors are related to a lifespan of the disposal container and integrity. In standards in relation to the physicochemical factors, corrosion resistance is the most important, the mechanical strength, in normal, embrittlement sensitivity toward radiation, in normal, and quality dependency, important.

Accordingly, corrosion resistance needs to be firstly secured on selecting materials of the disposal container. Also, lots of disposal container should keep the identical quality and thus, it is important to require the quality dependency of materials. Although it is necessary to secure mechanical strength of containers, actually, most of metals are superior in strength and thus, the importance is in normal. Next, embrittlement matter induced by radiation in microelement of metals needs to be kept below acceptable value (ppm).

Further, materials of the disposal container should require superior processability and weldability and convenience in non-destructive inspection.

However, there is a problem in which the disposal container, manufactured so far, has not been satisfied for the properties.

PRIOR ART (Patent document 001) Korean Patent Registration No. 10-1046515

(Patent document 002) Korean Patent Publication No. 10-2010-0057238

DISCLOSURE

Technical Problem

For solving above problems, the object of the present invention is to provide a disposal container for high-level radioactive waste using multiple barriers and a barrier system using thereof, the disposal container having the multiple barriers consisting of an inner wall made of carbon steel for excellent corrosion resistance and ease of manufacture, a middle wall made of Inconel, which is bonded to a lateral surface of the inner wall, and an outer wall made of copper, which is bonded to a lateral surface of the middle wall.

Further, the another object of the present invention is to provide a disposal container for high-level radioactive waste using multiple barriers and a barrier system using thereof, attaching a heat sink to a lateral surface of the outer wall of the disposal container, arranging a radiation fin vertically between the heat sink and the outer wall, and installing a siphon pipe between the heat sink and the outer wall, thereby discharging heat, generated from the disposal container, outside for cooling.

Further, the another object of the present invention is to provide a disposal container for high-level radioactive waste using multiple barriers and a barrier system using thereof, wherein a deposition hole is vertically formed at a repository tunnel in rock formation and the disposal container is installed inside the deposition hole, thereby being filled with Na-Bentonite as a filler.

Technical Solution

To accomplish above objects, the present invention comprises an inner wall, made of carbon steel, for being cylindrical in shape; a middle wall, made of Inconel, for being cylindrical in shape and bonded to an outer surface of the inner wall; and an outer wall, made of copper, for being bonded to a lateral surface of the middle wall.

Hereinafter, the outer wall further installs a heat sink made of aluminum or copper and separated from a lateral surface for releasing heat which is generated inside and transferred to the outer wall, and a radiation fin made of materials same as the heat sink is combined between the heat sink and the outer wall.

Hereinafter, the radiation fin is combined to the lateral surface of the heat sink.

Hereinafter, a siphon pipe for storing refrigerants at a certain level is further installed between the heat sink and the outer wall, thereby making the inside in a vacuum state for releasing heat generated from the inside to the outer wall.

A barrier system using the disposal container of high-level radioactive waste using multiple barriers comprises a disposal tunnel which is formed by digging rock formation; a deposition hole which is vertically or horizontally perforated, thereby storing the disposal container; and a buffer which is filled with the deposition hole and the disposal container.

Hereinafter, the buffer is composed of Na-Bentonite.

Advantageous Effects

According to a disposal container for high-level radioactive waste using multiple barriers and a barrier system using thereof of the present invention, as constituted above, it provides a disposal container with multiple barriers consisting of an inner wall made of carbon steel, a middle wall made of Inconel, which is bonded to a lateral surface of the inner wall, and an outer wall made of copper, which is bonded to a lateral surface of the middle wall, thereby providing relatively superior corrosion resistance and manufacturing convenience.

Further, according to the present invention, a heat sink is attached to a lateral surface of the outer wall of the disposal container; a radiation fin is arranged vertically between the heat sink and the outer wall; and a siphon pipe is installed between the heat sink and the outer wall, thereby discharging heat, generated from the disposal container, outside for cooling, thereby enabling to provide safe storage.

Further, according to the present invention, a deposition hole is vertically formed at a repository tunnel in rock formation and the disposal container is installed inside the deposition hole, thereby being filled with Na-Bentonite as a filler, thereby satisfying property and economic feasibility.

DESCRIPTION OF THE PREFERRED EMBODIMENTS

The configuration of a disposal container of high-level radioactive waste using multiple barriers of the present invention will be described in detail with the accompanying drawings.

In the following description of the present invention, a detailed description of known incorporated functions and configurations will be omitted when to include them would make the subject matter of the present invention rather unclear. Also, the terms used in the following description are defined taking into consideration the functions provided in the present invention. The definitions of these terms should be determined based on the whole content of this specification, because they may be changed in accordance with the option of a user or operator or a usual practice.

Figure 1:
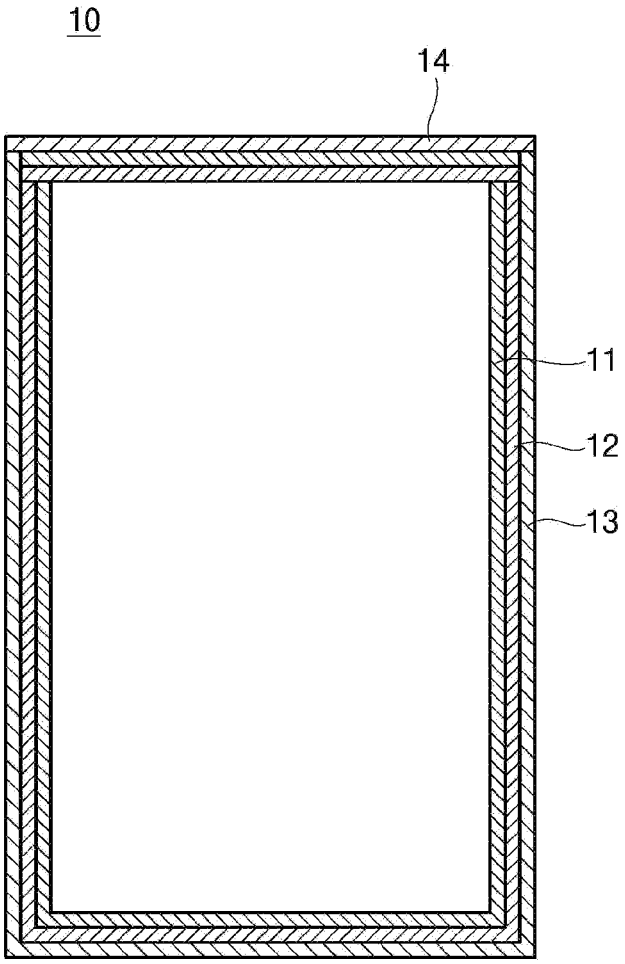
FIG. 1 illustrates a front sectional view showing the constitution of a disposal container of high-level radioactive waste using multiple barriers according to the present invention.
Figure 2:
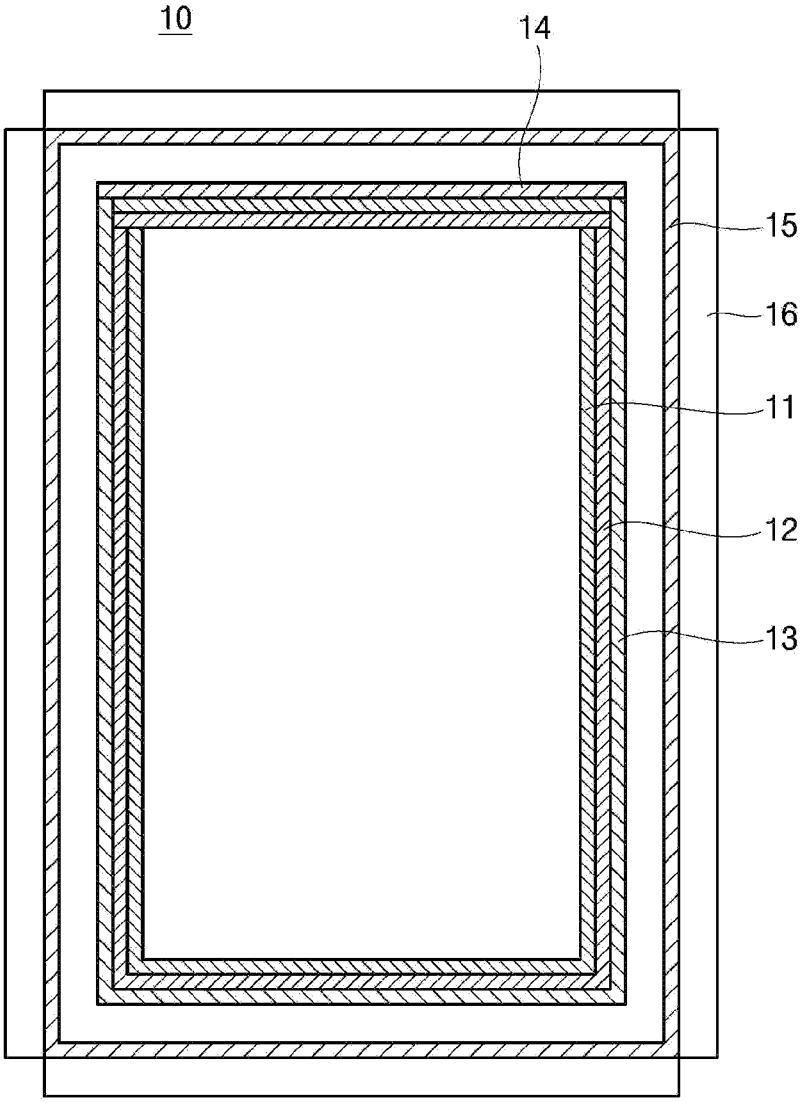
FIG. 2 illustrates a front sectional view showing the constitution of a disposal container of high-level radioactive waste using multiple barriers according to other embodiments of the present invention.
Figure 3:
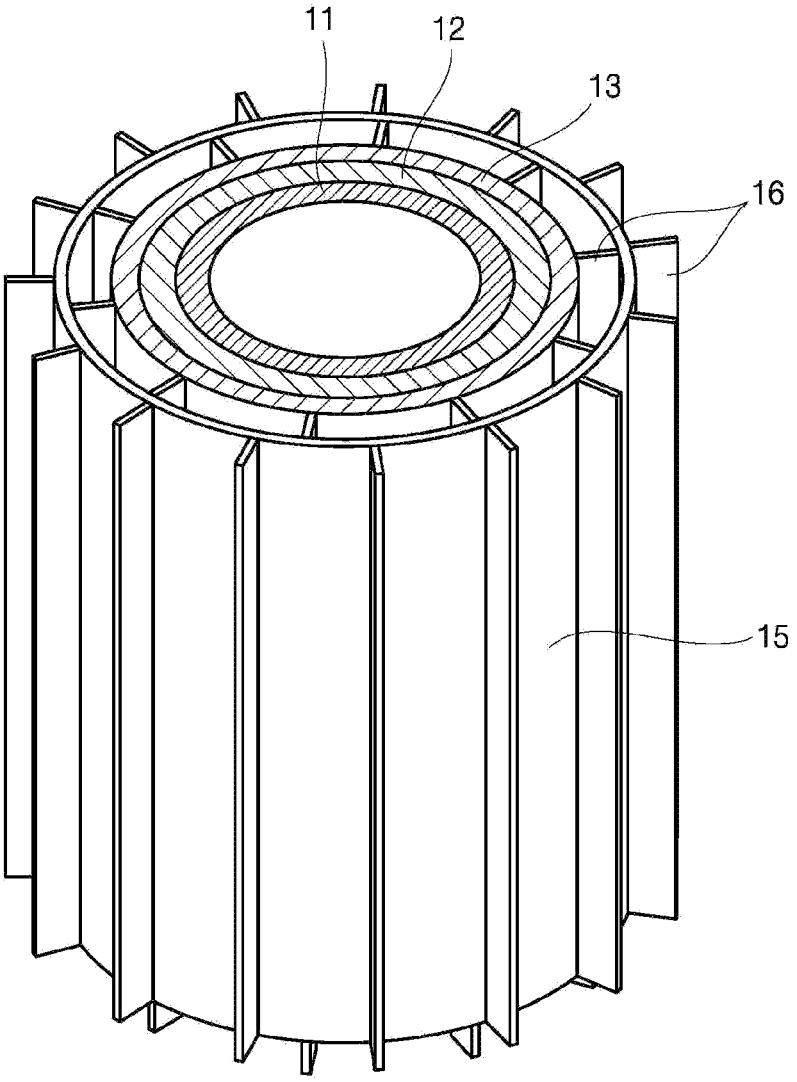
FIG. 3 illustrates a partial sectional perspective view of FIG. 2.
Figure 4:
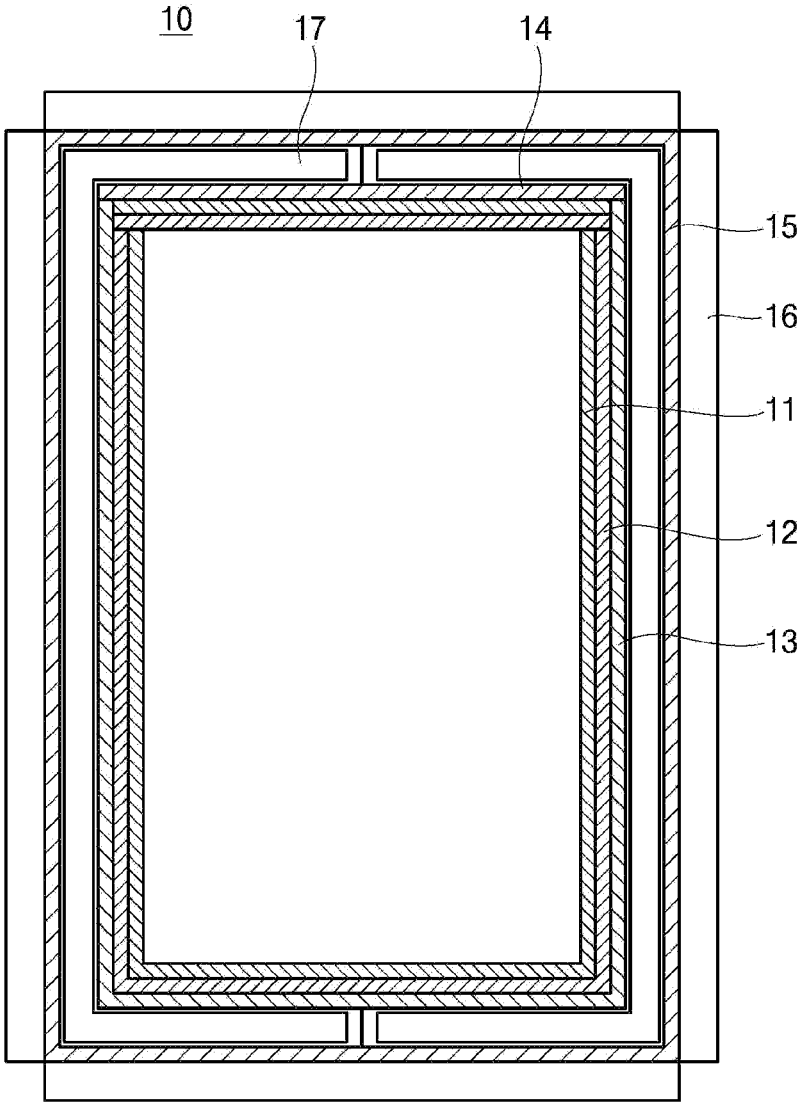
FIG. 4 illustrates a front sectional view showing the constitution of a disposal container of high-level radioactive waste using multiple barriers according to another embodiments of the present invention.
Figure 5:
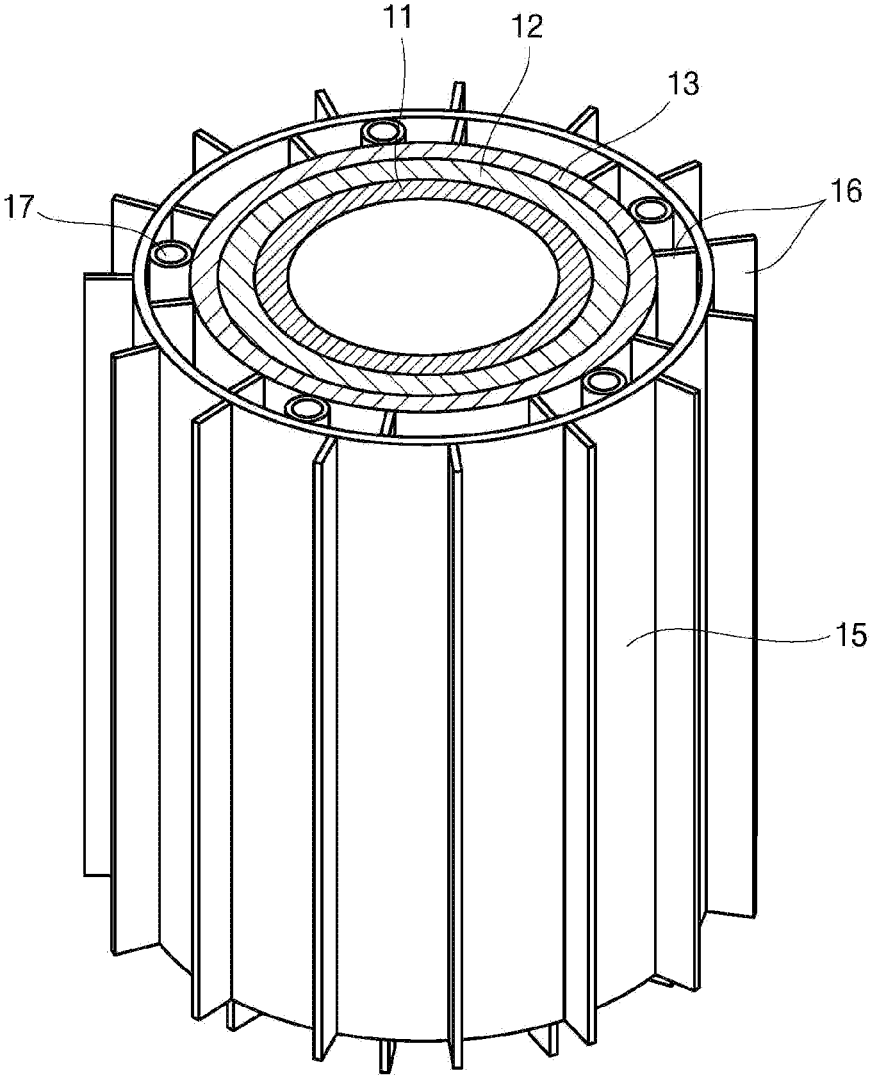
FIG. 5 illustrates a partial sectional perspective view of FIG. 4.

FIG. 1 illustrates a front sectional view showing the constitution of a disposal container of high-level radioactive waste using multiple barriers according to the present invention; FIG. 2 illustrates a front sectional view showing the constitution of a disposal container of high-level radioactive waste using multiple barriers according to other embodiments of the present invention; FIG. 3 illustrates a partial sectional perspective view of FIG. 2; FIG. 4 illustrates a front sectional view showing the constitution of a disposal container of high-level radioactive waste using multiple barriers according to another embodiments of the present invention; and FIG. 5 illustrates a partial sectional perspective view of FIG. 4.

Referring to FIGS. 1 to 5, a disposal container of high-level radioactive waste using multiple barriers (10) according to the present invention consists of an inner wall (11), a middle wall (12) and an outer wall (13).

First, the inner wall (11) made of carbon steel for excellent economic value and ease of manufacture is cylindrical in shape. Hereinafter, it is desirable that an upper side of the inner wall (11) is open for storing high-level radioactive waste inside, and a thickness may be adjustable optionally.

Further, the middle wall (12) made of Inconel for excellent corrosion resistance is bonded to a lateral surface of the inner wall. Hereinafter, it is desirable that an upper side of the middle wall (12) is open for storing high-level radioactive waste inside equally to the inner wall (11), and a thickness may be adjustable optionally.

Further, the outer wall (13) made of copper for excellent corrosion resistance is bonded to a lateral surface of the middle wall (12). Hereinafter, it is desirable that an upper side of the outer wall (13) is open for storing high-level radioactive waste inside equally to the inner wall (11), and a thickness may be adjustable optionally.

Meanwhile, the upper sides of the inner wall (11), the middle wall (12), and the outer wall (13) are bonded to a cover (14), wherein a thickness of the cover (14) is the same with that of the upper sides of the inner wall (11), the middle wall (12), and the outer wall (13), by triplex-forming from a bottom in a series of carbon steel, Inconel, and copper.

Continuously, as illustrated in FIGS. 2 and 3, the disposal container of high-level radioactive waste using multiple barriers (10) according to the present invention further installs a heat sink (15) made of aluminum or copper and separated from a lateral surface for releasing heat which is generated inside the inner wall (11) and transferred to the outer wall (13).

Further, a radiation fin (16) made of materials same as the heat sink (15) is vertically combined between the heat sink (15) and the outer wall (13), and the radiation fin (16) is vertically combined even to the lateral surface of the heat sink (15), selectively.

The strength between the heat sink (15) and the outer wall (13) may be further reinforced by installing such radiation fin (16).

Further, if a thickness of the radiation fin (16) is thin in the center and gets thicker towards the outside, thin parts are broken under earthquake and shock is absorbed, thereby further enabling to improve seismic performance.

Further, as illustrated in FIGS. 4 and 5, a siphon pipe (17) for storing refrigerants at a certain level may be further installed between the heat sink (15) and the outer wall (13), thereby making the inside in a vacuum state for releasing heat generated from the inside of the inner wall (11) and transferred to the outer wall (13).

Hereinafter, in the siphon pipe (17), if heat generated from high-level radioactive waste is transferred through the inner wall (11), the middle wall (12), and the outer wall (13), the refrigerants vaporize into steam due to transferred heat and move up; the vaporized steam frozen by temperature of the heat sink (15) is converted to liquid refrigerants and moves down; vaporization and falling are repeated, thereby cooling the outer wall (13) and transferring cooling heat to the outer wall (13), the middle wall (12), and the inner wall (11).

Hereinafter, the constitution of a barrier system using a disposal container of high-level radioactive waste using multiple barriers according to the present invention will be described in detail with the accompanying drawing.

Figure 6:
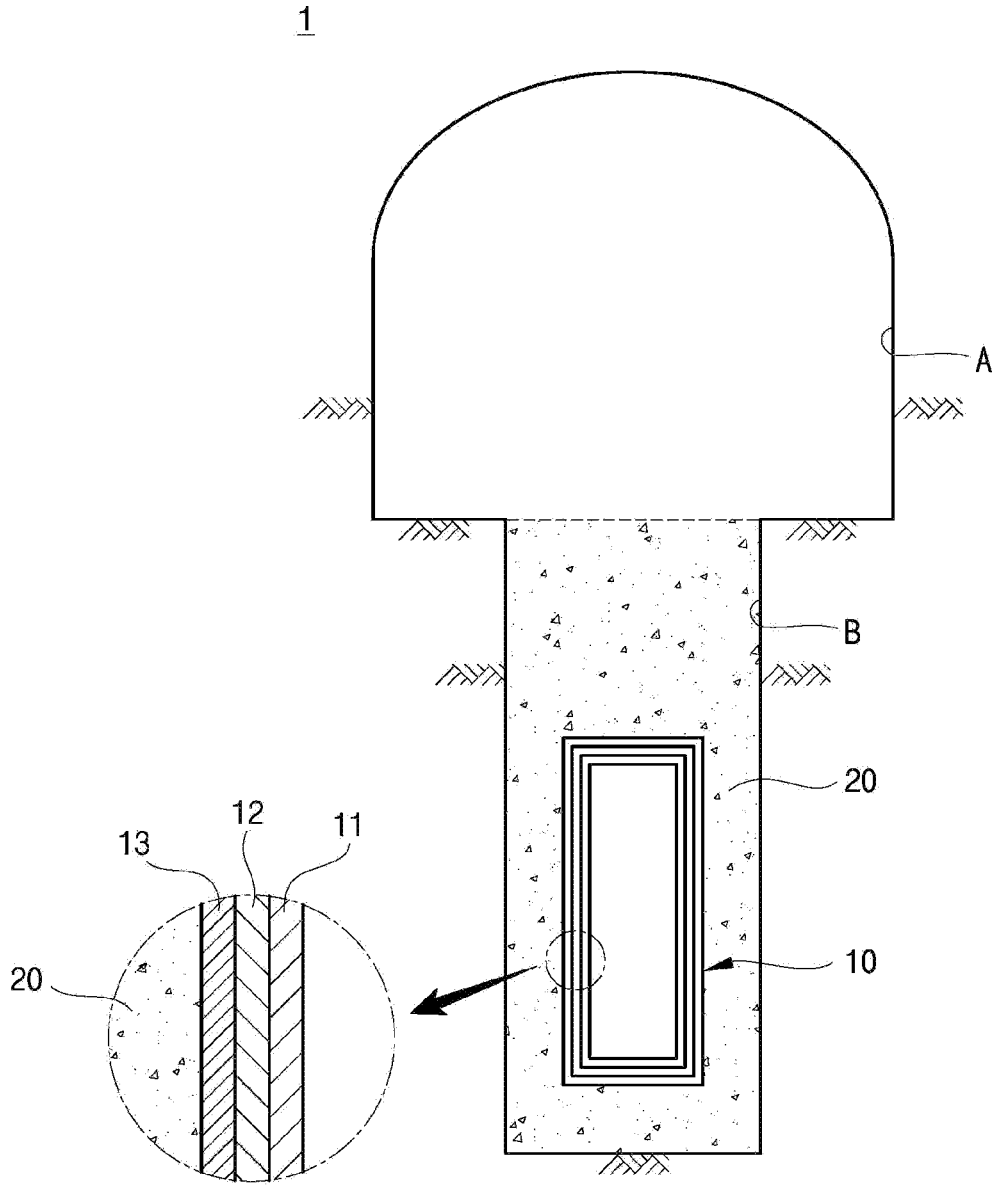
FIGS. 6 to 8 illustrate sectional views showing the constitution of a barrier system using the disposal container of high-level radioactive waste using multiple barriers according to the present invention.
Figure 7:
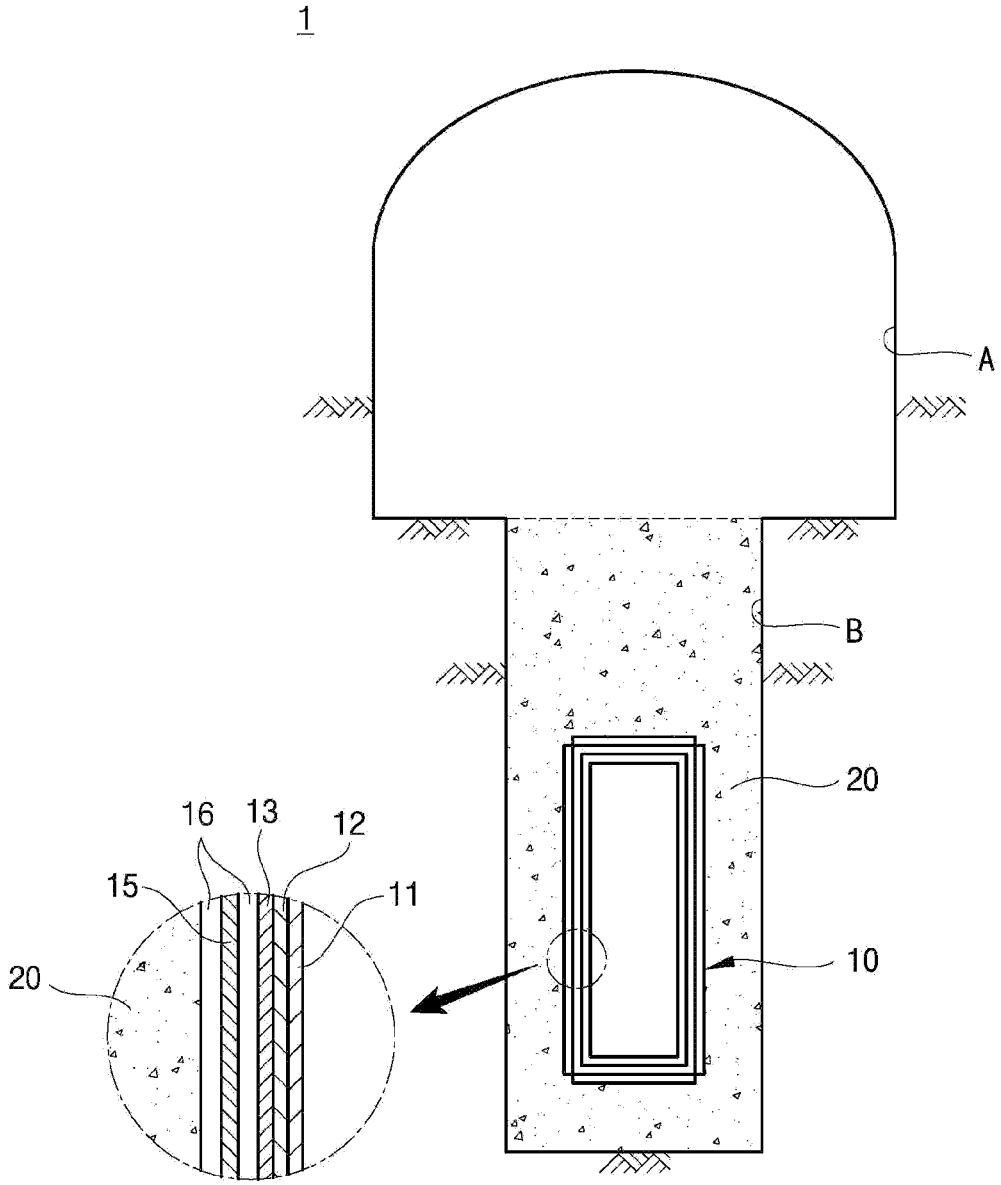
Figure 8:
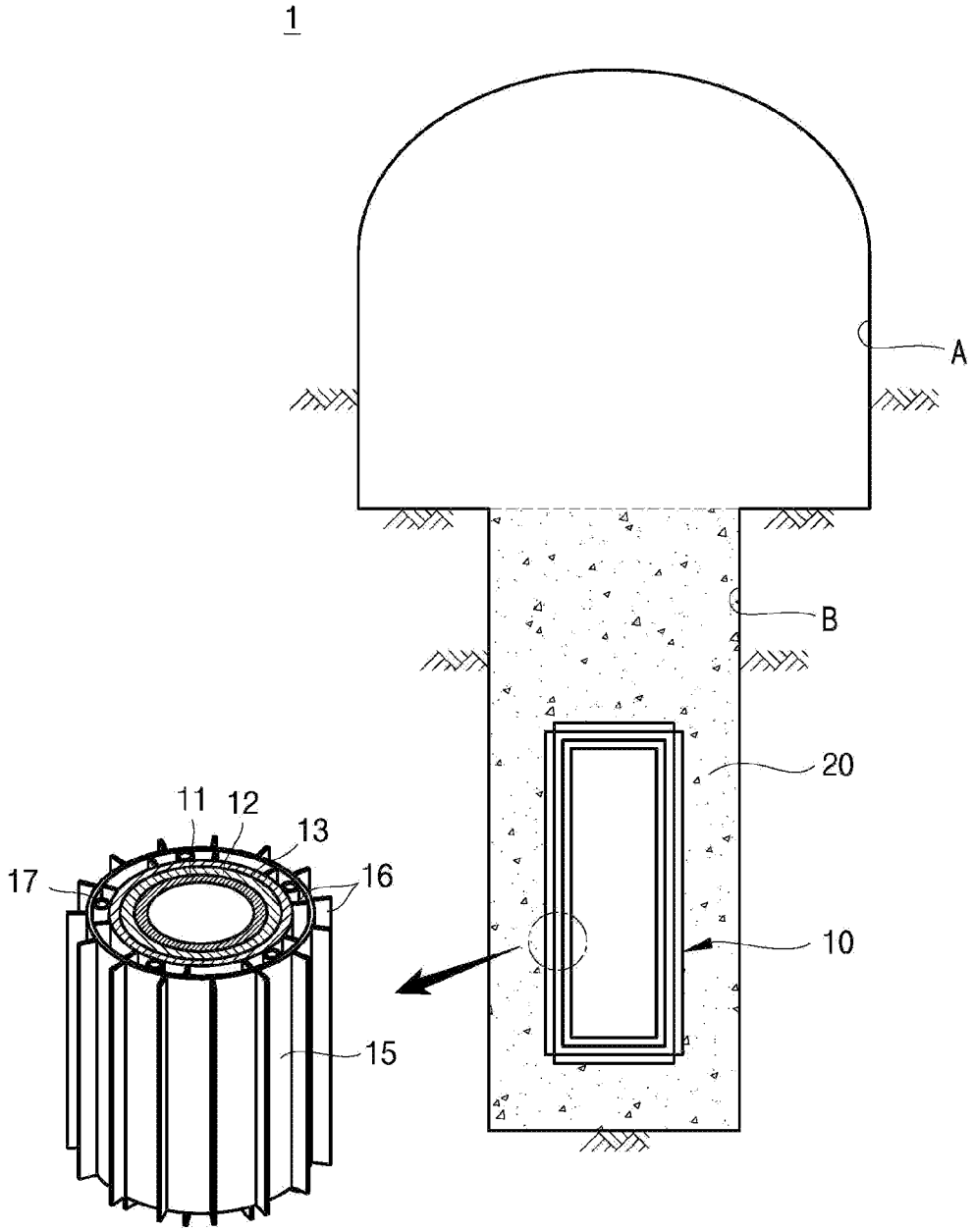

FIGS. 6 to 8 illustrate sectional views showing the constitution of a barrier system using the disposal container of high-level radioactive waste using multiple barriers according to the present invention.

Referring to FIGS. 6 to 8, the barrier system using a disposal container of high-level radioactive waste using multiple barriers (1) according to the present invention consists of a disposal tunnel (A), a deposition hole (B), a disposal container (10), and a buffer (20).

First, the disposal tunnel (A), as a general structure, is formed by digging rock formation.

Further, the deposition hole (B) is vertically or horizontally perforated in the disposal tunnel (A), thereby storing the disposal tunnel (A).

Further, as explained above, the disposal container (10) is composed of the inner wall (11), the middle wall (12) and the outer wall (13). Here, in the disposal container (10), the heat sink (15) is installed to the outer wall (13); and the radiation fin (16) may be further installed between the outer wall (13) and the heat sink (15), and the heat sink (15) outside, or the siphon pipe (17) may be installed between the heat sink (15) and the outer wall.

Further, the buffer (20) is filled in the space between the deposition hole (B) and the disposal container (10). Here, it is desirable that Na-bentonite is used in the buffer (20), and the buffer (20) may be block-shaped.

Meanwhile, if high-level waste repositories are constructed in deep crystalline rock, the buffer is compulsorily installed to prevent inflow of underground water through rock fracture, the disposal container corroded, and radioactive nuclide discharged. Along with the disposal container, the buffer is a key component of technological wall in high-level waste repositories. After digging deposition holes on the bottom of disposal cave and positioning the disposal container with wrapped waste, the buffer is installed by filling in the space between the disposal container and the rock wall of the deposition holes. The main functions of the buffer in the waste repositories are inflow suppression of underground water, control of discharge of radioactive nuclide, prevention of disposal container against external stress, and dispersion of decay heat, generated from waste, towards the outside, as well.

For selecting a suitable material as a buffer in high-level waste repositories, several countries have conducted on many substances. As a survey result, it is revealed that clay-based material and cement-based material may be utilized as a buffer. However, the cement material increases pH of underground water more than 12.5, and it may be possible to accelerate erosion of disposal container in such pH condition. Thus, clay-based material is more preferred, as a buffer.

The clay-based material has different physicochemical characteristics in accordance with constitutional minerals. As major minerals, there are Kaolinite, Illite, Montmorillonite, etc. Among them, Montmorillonite has higher swelling degrees than Kaolinite or Illite, thereby having much lower hydraulic conductivity under identical dry density. Also, since cation exchange capacity (CEC) and nuclide distribution coefficients are high due to large specific surface areas, it turns out to be superior as compared to other minerals even in radionuclide-retarding capacity. Thus, the more the clay-based material has Montmorillonite, the more it is known as being suitable as a buffer. Bentonite is a clay-based material, wherein it is primarily composed of Montmorillonite, thereby more preferring as buffer candidate than other clay in many countries currently planning on repository construction.

In contact with water, Bentonite has swelling degrees, wherein interlayer of Montmorillonite is hydrated and volume is increased. After placing the disposal container in the deposition hole, the empty space between the disposal container and the deposition holes is filled with Bentonite buffers, thereby swelling in contact with water when underground water from surrounding rocks gets through the inside of the deposition holes and then, blocking underground water penetration. Since Bentonite has extremely high swelling degrees as compared to other clay, empty spaces may be filled up by means of swelling when there are empty spaces or cracks in the buffer while installing the buffer. Also, Bentonite has high absorption capacity towards most of cationic nuclides, thereby effectively enabling to prevent radioactive nuclides to be discharged to surrounding rocks in case that radioactive nuclides are discharged from waste. Besides, Bentonite is a stabilized natural material form by long-term conformational changes, thereby enabling to maintain long-term stabilization by keeping original states without characteristics changes during life time of high-level waste disposal plant.

Bentonite may be classified into Na-Bentonite and Ca-Bentonite in accordance with types of exchangeable cation which exists in layers of Montmorillonite. Generally, Na-Bentonite has higher swelling than that of Ca-Bentonite and thus, it is known as more suitable buffer.

It is desirable that Na-Bentonite is used in the present invention.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

EXPLANATIONS OF NUMERAL REFERENCE

| | |
|---|---|
| 1: barrier system | 10: disposal container |
| 11: inner wall | 12: middle wall |
| 13: outer wall | 14: cover |
| 15: heat sink | 16: radiation fin |
| 17: siphon pipe | 20: buffer |
| A: disposal tunnel | B: deposition hole |

The invention claimed is:

1. A disposal container of high-level radioactive waste using multiple barriers, comprising:

an inner wall, made of carbon steel, for being cylindrical in shape; a middle wall, made of Inconel™, for being cylindrical in shape and bonded to an outer surface of the inner wall; and an outer wall, made of copper, for being bonded to a lateral surface of the middle wall.

2. The disposal container of high-level radioactive waste using multiple barriers, according to claim 1, wherein the outer wall further installs a heat sink made of aluminum or copper and separated from a lateral surface for releasing heat which is generated inside and transferred to the outer wall, and a radiation fin made of materials same as the heat sink is combined between the heat sink and the outer wall.

3. The disposal container of high-level radioactive waste using multiple barriers, according to claim 2, wherein the radiation fin is combined to the lateral surface of the heat sink.

4. The disposal container of high-level radioactive waste using multiple barriers, according to claim 1, wherein a siphon pipe for storing refrigerants at a certain level is further installed between the heat sink and the outer wall, thereby making the inside in a vacuum state for releasing heat generated from the inside to the outer wall.

5. A barrier system using the disposal container of high-level radioactive waste using multiple barriers in claim 1, comprising:

a disposal tunnel which is formed by digging rock formation;

a deposition hole which is vertically or horizontally perforated, thereby storing the disposal container;

and a buffer which is filled with the deposition hole and the disposal container.

6. The barrier system using the disposal container of high-level radioactive waste using multiple barriers according to claim 5, wherein the buffer is composed of Na-Bentonite.

* * * * *